US009836900B2

(12) United States Patent
Jun et al.

(10) Patent No.: US 9,836,900 B2
(45) Date of Patent: Dec. 5, 2017

(54) BINDING DEVICE WITH EMBEDDED SMART KEY AND METHOD FOR CONTROLLING OBJECT USING THE SAME

(71) Applicant: Samsung Electronics Co., Ltd., Gyeonggi-do (KR)

(72) Inventors: HeeJune Jun, Gyeonggi-do (KR); Chan Woo Park, Gyeonggi-do (KR); Chan Yil Kim, Gyeonggi-do (KR); Byoung Joo Ra, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/158,133

(22) Filed: May 18, 2016

(65) Prior Publication Data

US 2016/0343186 A1 Nov. 24, 2016

(30) Foreign Application Priority Data

May 18, 2015 (KR) ..... 10-2015-0068739

(51) Int. Cl.
*G07C 9/00* (2006.01)
*G08B 7/06* (2006.01)
(Continued)

(52) U.S. Cl.
CPC ..... *G07C 9/00119* (2013.01); *G07C 9/00309* (2013.01); *G07C 9/00563* (2013.01);
(Continued)

(58) Field of Classification Search
CPC ..... G07C 9/00119; G07C 9/00309; G07C 9/00563; G07C 2009/00095; G07C 2009/00404; G07C 2009/00587; G07C 2009/00793; G07C 2009/00968; G08B 7/06; A44C 5/0007; A44C 5/18
See application file for complete search history.

(56) References Cited

U.S. PATENT DOCUMENTS 4,232,512 A 11/1980 Yoshlkawa et al.
7,734,046 B2 6/2010 Urban et al.
(Continued)

FOREIGN PATENT DOCUMENTS

JP 2010077603 4/2010
KR 20150014788 2/2015
(Continued)

OTHER PUBLICATIONS

European Search Report dated Oct. 7, 2016 issued in counterpart application No. 16169637.2-1953, 7 pages.
(Continued)

*Primary Examiner* — Leon Flores
(74) *Attorney, Agent, or Firm* — The Farrell Law Firm, P.C.

(57) ABSTRACT

Provided is a binding device and method of operation of the binding device, with the binding device including a strap including a body, a first area formed inside the body, with a smart key related control circuit disposed in the first area, and a second area formed on one side of the body, with a battery for supplying electric power for operating the smart key related control circuit seated on the second area such that at least a portion of the battery is exposed, and a cover formed to cover the second area.

16 Claims, 11 Drawing Sheets

(51) Int. Cl.
*A44C 5/00* (2006.01)
*A44C 5/18* (2006.01)

(52) U.S. Cl.
CPC ..... *G08B 7/06* (2013.01); *A44C 5/0007* (2013.01); *A44C 5/18* (2013.01); *G07C 2009/00095* (2013.01); *G07C 2009/00404* (2013.01); *G07C 2009/00587* (2013.01); *G07C 2009/00793* (2013.01); *G07C 2009/00968* (2013.01); *G07C 2209/61* (2013.01)

(56) References Cited

U.S. PATENT DOCUMENTS

| | | | | |
|---|---|---|---|---|
| 8,908,479 | B2 | 12/2014 | Teng et al. | |
| 2003/0174049 | A1 | 9/2003 | Beigel et al. | |
| 2003/0174065 | A1* | 9/2003 | Losey | G08C 17/00 340/13.24 |
| 2007/0164611 | A1 | 7/2007 | Spies | |
| 2007/0174612 | A1 | 7/2007 | Urban et al. | |
| 2011/0102164 | A1* | 5/2011 | Ghabra | B60R 25/04 340/426.13 |
| 2014/0177399 | A1 | 6/2014 | Teng et al. | |
| 2014/0375465 | A1 | 12/2014 | Fenuccio et al. | |
| 2015/0085623 | A1 | 3/2015 | Modaragamage | |
| 2015/0378312 | A1 | 12/2015 | Modaragamage | |
| 2016/0306350 | A1* | 10/2016 | Shim | G05D 1/0016 |

FOREIGN PATENT DOCUMENTS

| | | |
|---|---|---|
| KR | 101509596 | 4/2015 |
| WO | WO 01/20463 | 3/2001 |
| WO | WO 03/079298 | 9/2003 |

OTHER PUBLICATIONS

European Search Report dated Jan. 24, 2017 issued in counterpart application No. 16169637.2-1953, 13 pages.

* cited by examiner

BINDING DEVICE WITH EMBEDDED SMART KEY AND METHOD FOR CONTROLLING OBJECT USING THE SAME

PRIORITY

This application claims priority under 35 U.S.C. §119(a) to a Korean Patent Application filed in the Korean Intellectual Property Office on May 18, 2015, and assigned Serial No. 10-2015-0068739, the entire contents of which are incorporated herein by reference.

BACKGROUND

1. Field of the Disclosure

The present disclosure generally relates to a binding device with an embedded smart key.

2. Description of the Related Art

In recent years, attention has been made to smart keys capable of sensing and authenticating a target object through bidirectional communication with the target object, e.g., a vehicle. Controlling an authenticated target object has also received increasing attention.

SUMMARY

The present disclosure has been made to address at least the above-mentioned problems and/or disadvantages and to provide at least the advantages described below. Accordingly, an aspect of the present disclosure provides a binding device having a smart key therein to enhance the portability and in-use efficiency of the smart key.

Another aspect of the present disclosure provides a binding device including a communication circuit for communication with an external electronic device connected to the binding device.

In accordance with an aspect of the present disclosure, a binding device is provided that includes a strap including a body, a first area formed inside the body, with a smart key related control circuit disposed in the first area, and a second area formed on one side of the body, with a battery for supplying electric power for operating the smart key related control circuit seated on the second area such that at least a portion of the battery is exposed, and a cover formed to cover the second area.

In accordance with a further aspect of the present disclosure, there is provided a method for controlling a target object of a binding device, with the method including transmitting a sensing signal for sensing the target object through a first antenna that transmits and receives a signal in a specific frequency band, with the first antenna provided in a smart key related control circuit disposed inside a strap of the binding device; receiving an authentication signal comprising authentication information of the target object through the first antenna in response to the sensing signal; authenticating the target object based on the authentication information contained in the authentication signal; and transmitting a control signal for controlling the target object through the first antenna.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION OF THE EMBODIMENTS OF THE PRESENT DISCLOSURE

Figure 1A:
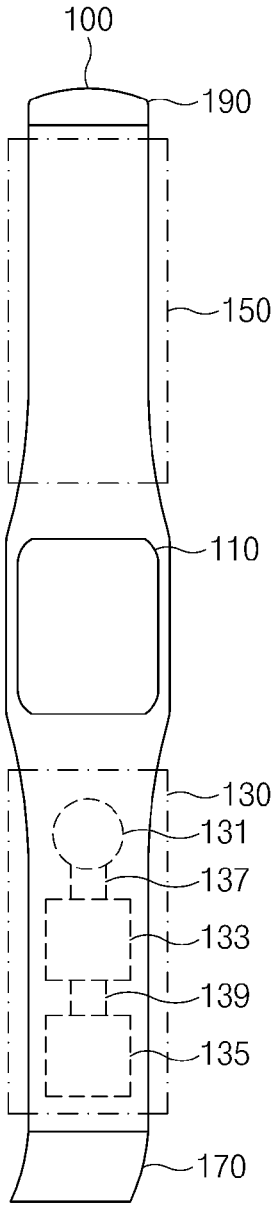
FIG. 1A is a plan view of a binding device according to an embodiment of the present disclosure.

Herein, embodiments of the present disclosure are described with reference to the accompanying drawings. Accordingly, those of ordinary skill in the art will recognize that modification, equivalent, and/or alternative on the embodiments described herein can be made without departing from the scope and spirit of the present disclosure.

In the present disclosure, it should be understood that the terms "have", "may have", "include", "comprise", "may include" and "may comprise" indicate existence of corresponding features, e.g., elements such as numeric values, functions, operations, or components, but do not exclude presence of additional features.

In the present disclosure, expressions "A or B", "at least one of A or/and B", or "one or more of A or/and B", and the like include any and all combinations of one or more of the associated listed items. For example, the term "A or B", "at least one of A and B", or "at least one of A or B" may refer to each of when (1) at least one A is included, (2) at least one B is included, and (3) both of at least one A and at least one B are included.

Although ordinal terms, such as "first" and "second" may be used to describe various elements of the present disclosure, such terms do not limit these elements. Rather, the terms are used merely to distinguish an element from another element and do not limit the order and/or priority of the elements. For example, a first user device and a second user device may represent different user devices irrespective of sequence or importance, and a first element may be referred to as a second element and a second element may be referred to as a first element, without departing the scope of the present disclosure.

It will be understood that when an element (e.g., a first element) is referred to as being "(operatively or communicatively) coupled with/to" or "connected to" another element (e.g., a second element), such element can be directly coupled with/to or connected to the other element or an intervening element (e.g., a third element) that may be present. In contrast, when an element (e.g., a first element) is referred to as being "directly coupled with/to" or "directly connected to" another element (e.g., a second element), it should be understood that there is no intervening element (e.g., a third element).

According to the situation, the expression "configured to" may be used interchangeably with, for example, "suitable for", "having the capacity to", "designed to", "adapted to", "made to", or "capable of". The term "configured or set to" does not mean that a component is only "specifically designed to" function with certain hardware. Instead, the expression "a device is configured to" may mean that the device is "capable of" operating together with another device or one or more other components. A central processing unit (CPU), for example, includes a "processor configured to (or set to) perform A, B, and C", and can include a dedicated processor (e.g., an embedded processor) for performing a corresponding operation or a generic-purpose processor (e.g., a CPU or an application processor) which can perform corresponding operations by executing one or more non-transitory software programs which are stored in a memory device.

Terms used herein to describe specified embodiments of the present disclosure are not intended to otherwise limit the scope of the present disclosure. The terms of a singular form may also include plural forms unless otherwise specified. Unless otherwise defined herein, the terms used herein that include technical or scientific terms may have the same meaning that is generally understood by a person skilled in the art. It will be further understood that terms, which are defined in a dictionary and commonly used, should also be interpreted as is customary in the relevant related art and not in an idealized or overly formal manner, unless expressly so defined herein in embodiments of the present disclosure. In some cases, even terms defined herein are not to be interpreted to exclude embodiments of the present disclosure.

An electronic device according to an embodiment of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), MP3 players, mobile medical devices, cameras, and wearable devices. Wearable devices may include accessories (for example, watches, rings, bracelets, ankle bracelets, glasses, contact lenses, or head-mounted devices (HMDs)), clothing-integrated devices (for example, electronic clothing), body-attached devices (for example, skin pads or tattoos), or implantable devices (for example, implantable circuits).

In an embodiment of the present disclosure, the electronic device may be a home appliance, and may include, for example, at least one of a digital video disk (DVD) player, an audio player, a refrigerator, an air conditioner, a cleaner, an oven, a microwave oven, a washing machine, an air cleaner, a set-top box, a home automation control panel, a security control panel, a TV box (for example, Samsung HomeSync™, Apple TV™, or Google TV™), a game console (for example, Xbox™ or PlayStation™), an electronic dictionary, an electronic key, a camcorder, and an electronic panel.

In another embodiment of the present disclosure, the electronic device includes a medical device, e.g., a portable medical measurement device (e.g., a blood glucose meter, a heart rate measuring device, a blood pressure measuring device, and a body temperature measuring device), a magnetic resonance angiography (MRA) device, a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (for example, a navigation device for vessels and a gyro compass), an avionics device, a security device, a vehicular head unit, an industrial or home robot, an automatic teller machine (ATM) of a financial institution, a store point of sale (POS) device, or an Internet of Things (IoT) device (for example, a light bulb, various sensors, an electricity or gas meter, a spring cooler device, a fire alarm device, a thermostat, an electric light post, a toaster, a sporting apparatus, a hot water tank, a heater, a furnace and a boiler).

According to an embodiment of the present disclosure, the electronic device includes at least one of furniture or a part of a building/structure, an electronic board, an electronic signature receiving device, a projector, or various measurement devices (for example, a water service, electricity, gas, or electric wave measuring device). In an embodiment of the present disclosure, the electronic device may be one or a combination of the aforementioned devices. The electronic device according to an embodiment of the present disclosure may be a flexible electronic device. Further, the electronic device is not limited to the aforementioned existing devices, and may include new electronic devices produced after or based on such technologies.

Hereinafter, electronic devices will be described with reference to the accompanying drawings. The term "user" refers to a person who uses an electronic device or may refer to a device (for example, an artificial intelligence electronic device) that uses an electronic device.

Figure 1B:
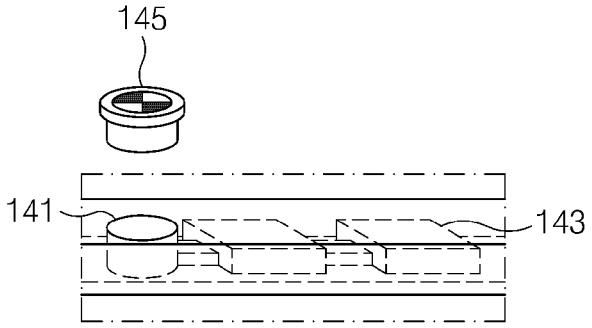
FIG. 1B is a perspective view of a part of the binding device according to an embodiment of the present disclosure.
Figure 1C:
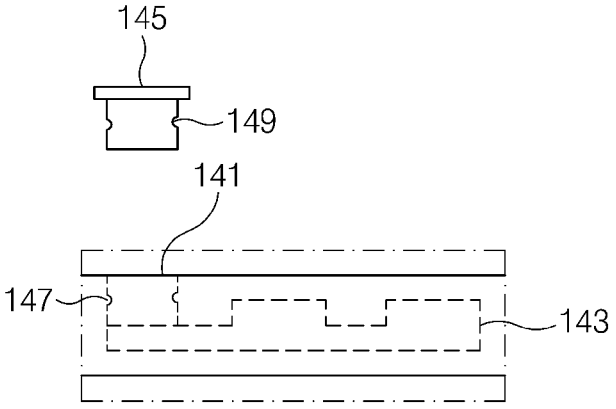
FIG. 1C is a side view of a part of the binding device illustrated in FIG. 1B.

FIG. 1A is a plan view of a binding device according to an embodiment of the present disclosure. FIG. 1B is a perspective view of a part of the binding device according to the embodiment of the present disclosure. FIG. 1C is a side view of a part of the binding device illustrated in FIG. 1B.

Referring to FIGS. 1A to 1C, the binding device includes a strap 100 and a cover 145. The strap 100 has a body and a binder, i.e. a binding part. The strap 100 has an opening 110 such that a main body of an external electronic device, for example, a smart watch, may be attached to and detached from the body of the strap 100. The opening 110 is provided in a predetermined area (for example, a central area) of the body. The opening 110 has a shape and a size that are the same as or similar to a corresponding opening of the external electronic device. According to an embodiment, the strap 100 may have a groove having a predetermined form at a periphery of the opening 110 to support and fix the external electronic device.

The strap 100 has a first band 130 extending from the opening 110 in a first direction by a predetermined length, and a second band 150 extending from the opening 110 in a second direction different from the first direction by a predetermined length. As an example, the second band 150 is connected to a surface of the periphery of the opening 110 that is opposite to the surface where the first band 130 and the opening 110 meet, and extends in a direction opposite to the first band 130 by a predetermined length. According to an embodiment, the second band 150 may be omitted from the strap 100, with opposite peripheries of the first band 130 connected to the opening 110. The first band 130 and the second band 150 provide band-shaped supports that surround a part of the body of the user. The first band 130 or the second band 150 may be formed of rubber, plastic, leather, or metal. According to an embodiment of the present disclosure, the strap 100 may be configured such that the first band 130 and the second band 150 are divided with respect to the opening 110, with a connector that functions a connection function of the external electronic device provided at at least one periphery of the first band 130 and the second band 150.

A first area 143 in which a smart key related control circuit is disposed is provided inside the first band 130. The first area 143 is a hollow or an empty space in which, for example, a circuit board (for example, a first circuit board 137 or a second circuit board 139), a control chip 133, and a first antenna 135 are disposed. At least a portion of the first area 143 is connected to a second area 141. For example, a lower surface of the second area 141 is connected to the first area 143 such that a battery 131 is connected to the circuit board.

The first band 130 includes a second area 141 in which the battery 131 is seated. The second area 141 is a hollow or an empty space with, for example, a shape and a size that correspond to the shape and size of the battery 131. The second area 141 is a hollow or an area that is recessed from one side surface of the first band 130 by a predetermined depth such that the battery 131 is seated thereon. At least one groove or at least one bump 147 is formed in a predetermined portion of a side wall of the second area 141 to be coupled to the cover 145.

According to an embodiment of the present disclosure, a third area in which at least a portion of the control circuit is disposed is formed inside the second band 150. For example, at least some of the constituent elements of the control circuit are disposed in the third area, and the constituent elements of the control circuit disposed in the first area 143 are connected to the constituent elements of the control circuit disposed in the third area through at least one connection circuit disposed inside the strap 100.

At least one of the first band 130 and the second band 150 of the strap 100 has a binder in a predetermined area of an opposite periphery of the surface thereof connected to the opening 110. For example, a first binder 170 is provided in a predetermined area of an opposite periphery of the surface where the first band 130 meets the opening 110, and a second binder 190 is provided in a predetermined area of an opposite periphery of the surface where the second band 150 meets the opening 110. The first binder 170 and the second binder 190 are paired to be connected to each other such that the first band 130 and the second band 150 are connected to each other to be fixed to a part of the body of the user. According to an embodiment, the first binder 170 and the second binder 190 may be physically connected to each other, with the first binder 170 being a hook, and the second binder 190 being a fixing unit having a hole. The first binder 170 and the second binder 190 may be magnetically connected to each other, with the first binder 170 and the second binder 190 including corresponding magnetic and ferrous materials. According to an embodiment, the first binder 170 and the second binder 190 may also be buckles. As another example, the first binder 170 and the second binder 190 may be fixedly connected to each other.

The cover 145 covers the second area 141. For example, the cover 145 covers the second area such that the battery seated on the second area 141 is not shift outside of the cover 145. The cover 145 has a shape and a size that are the same as or similar to those of the second area 141. The cover may have at least one bump or at least one groove 149 to be coupled to the second area 141 of the strap 100. For example, at least a portion of the cover 145 may be inserted into the second area 141 of the strap 100 while being engaged with the second area 141 of the strap 100, and if a pressure having a predetermined magnitude is applied to the cover 145 in a designated direction, the cover 145 may be coupled and fixed by the bump 147 formed in the strap 100 and the groove 149 formed in the cover 145.

According to an embodiment, the cover 145 may be disposed such that a separation preventing unit (for example, a rubber ring) of a specific material (for example, rubber) is adjacent to the groove 149. According to an embodiment of the present disclosure, the cover 145 may be coupled while protruding to the outside of the strap 100, and may also be coupled while being flat with any one surface of the strap 100 or recessed inwards. The cover 145 may include a spring or may be connected to a spring to be opened and closed in a push button type arrangement.

Figure 2:
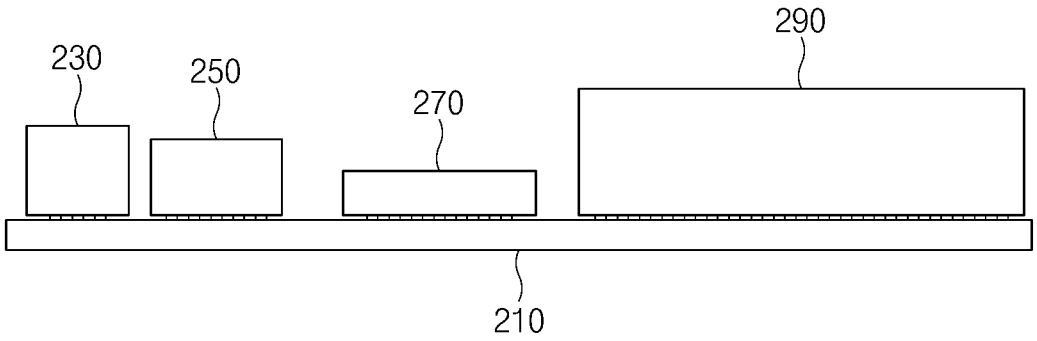
FIG. 2 illustrates a circuit of a smart key having a binding device therein according to an embodiment of the present disclosure.

FIG. 2 illustrates a circuit of a smart key having a binding device therein according to an embodiment of the present disclosure.

Referring to FIG. 2, the smart key circuit is configured such that a first part 230 of a first antenna, a second part 250 of the first antenna, a control chip 270, a battery 290, and the like are disposed on a circuit board 210. The circuit board 210 may be provided as at least one rigid printed circuit board (RPCB) or at least one flexible printed circuit board (FPCB).

The first part 230 of the first antenna and the second part 250 of the first antenna are spaced apart from each other by a predetermined distance, with the first antenna 135 may be classified in the x-axis, y-axis, and z-axis directions. For example, when the first part 230 of the first antenna is formed in the x-axis and y-axis directions, the second part 250 of the first antenna is formed in the z-axis direction. The first antenna is an antenna for transmitting a sensing signal to a target object (for example, a vehicle) and receiving an authentication signal from the target object. The first antenna may be a low frequency (LF) antenna.

The control chip 270 performs communication and calculation of data for sensing, authenticating, and controlling the target object. The control chip 270 includes a second antenna for near field communication (NFC) with the target object, and a processor. The processor may control, for example, transmission of a sensing signal for sensing the target object, and if an authentication signal is received from the target object, the target object may be authenticated. The processor may control transmission of a control signal for controlling the authenticated object. The second antenna may be an antenna for transmitting a control signal to the target object and receiving a feedback signal about the control signal from the target object. For example, the second antenna may be a radio frequency (RF) antenna.

According to an embodiment of the present disclosure, the control chip 270 includes a transmitter for transmitting a signal to the target object and a receiver for receiving a signal from the target object. Alternatively, the control chip 270 may have the first part 230 of the first antenna and the second part 250 of the first antenna in one chip.

According to an embodiment of the present disclosure, the first antenna may transmit and receive a signal having a low frequency band relative to the second antenna. Furthermore, the first antenna may be sensitive to interference from the second antenna. Accordingly, the first antenna may be disposed distant from an opening (for example, the opening 110 of FIG. 1) relative to the second antenna. According to an embodiment, the first antenna may be omitted, and the second antenna may replace the first antenna.

The battery 290 may function as the power source of the constituent elements disposed on the circuit board 210. Although a structure in which the constituent elements of the smart key circuit are disposed only on one surface of the circuit board 210 is illustrated in the drawings, in alternative embodiments of the present disclosure the constituent elements may be disposed on opposite surfaces of the circuit board 210. Furthermore, the battery 290 may be disposed on the left side of the first antenna or may be disposed between the first antenna and the control chip 270. The smart key circuit may further include a control circuit such as a filter or a switch.

According to an embodiment of the present disclosure, at least one additional constituent element is disposed on the circuit board 210, in addition to the aforementioned constituent elements. For example, the smart key circuit further includes a communication chip for communication with the external electronic device, for example, a smart watch that is inserted into and connected to the opening. According to an embodiment, the smart key circuit further includes a Bluetooth low energy (BLE) based communication chip. Furthermore, the smart key circuit may include additional sensors. For example, the smart key circuit may include a live body sensor, a gesture sensor, a voice sensor, a global positioning system (GPS) sensor, or a touch sensor.

Figure 3:
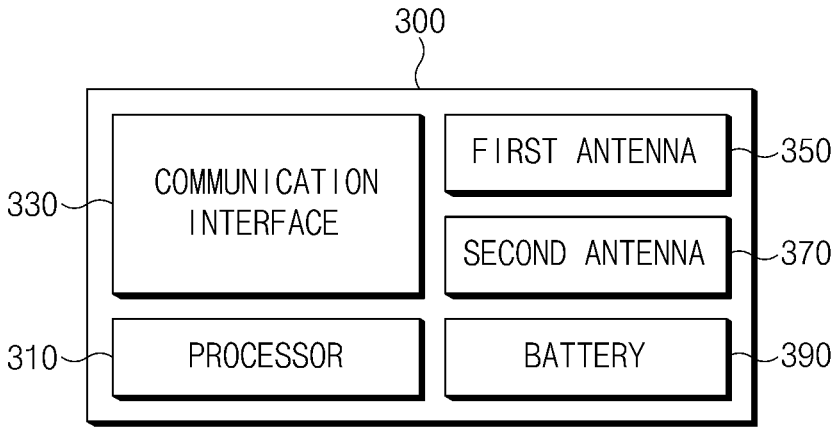
FIG. 3 is a block diagram of components of the smart key according to an embodiment of the present disclosure.

FIG. 3 is a block diagram of components of the smart key according to an embodiment of the present disclosure.

Referring to FIG. 3, the smart key 300 may include a processor 310, a communication interface 330, a first antenna 350, a second antenna 370, and a battery 390. The processor 310 controls the constituent elements included in the smart key 300 to sense, authenticate, and control a target object. For example, the processor 310 controls transmission of a sensing signal using the first antenna 350, based on the communication interface 330. According to an embodiment, the processor 310 controls transmission of sensing signals having a designated frequency band at a designated time interval. The processor 310 receives an authentication signal detected by the first antenna 350 based on the communication interface 330, and authenticates a target object using the received authentication signal.

According to an embodiment of the present disclosure, the processor 310 controls transmission of a control signal for controlling the authenticated object using the second antenna 370, based on the communication interface 330. According to an embodiment, the processor 310 controls transmission of a control signal regarding, for example, opening and closing of a locker of a target object (for example, opening and closing of a door of a vehicle or opening and closing of an entrance gate), or initiation and completion of a specific function of a target object (for example, turning on and off of a starter of a vehicle or turning on and off of a light lamp).

According to an embodiment of the present disclosure, the processor 310 transmits authentication information about a target object or a control signal to the external electronic device (for example, the body of a smart watch) using at least one of the first antenna 350, the second antenna 370, or an additional third antenna, based on the communication interface 330. In this case, the smart key 300 provides an interface with the user using a display included in the external electronic device.

The communication interface 330 establishes communication between the smart key 300 and a target object or between the smart key 300 and the external electronic device. For example, the communication interface 330 communicates with a target object or an external electronic device through wired or wireless communication. According to an embodiment, the communication interface 330 performs low frequency (LF) communication with a target object using the first antenna 350. The communication interface 330 may perform RF communication with a target object by using the second antenna 370. In an embodiment of the present disclosure, the communication interface 330 performs Bluetooth low energy (BLE) communication with a target object or an external electronic device, using at least one of the first antenna 350, the second antenna 370, or an additional third antenna.

The antenna 350 transmits a sensing signal to a target object and receives an authentication signal from the target object. The second antenna 370 transmits a control signal to a target object and receives a feedback signal from the target object. According to an embodiment, the first antenna 350 and the second antenna 370 are configured to transmit and receive signals of different frequency bands. According to an embodiment of the present disclosure, the smart key 300 further includes at least one antenna (for example, a third antenna), in addition to the first antenna 350 and the second antenna 370.

The battery 390 supplies electric power for operating the constituent elements included in the smart key 300. The battery 390 may be, for example, a coin cell battery. In an embodiment of the present disclosure, the battery 390 includes a rechargeable battery and/or a solar battery. For example, the battery 390 may be charged when an external voltage is applied to the battery 390. According to an embodiment, the smart key 300 may acquire electric power from a battery connected to the external electronic device (for example, the body of a smart watch). Furthermore, the smart key 300 supplies minimum electric power for controlling a target object by acquiring electric power from at least one of a battery connected to the external electronic device or an internal battery of the external electronic device when the power level of the battery 390 is low. Even when the power level of the battery 390 is low, the smart key 300 can start up a vehicle utilizing electric power from an internal battery of the external electronic device, i.e., the smart watch.

Figure 4A:
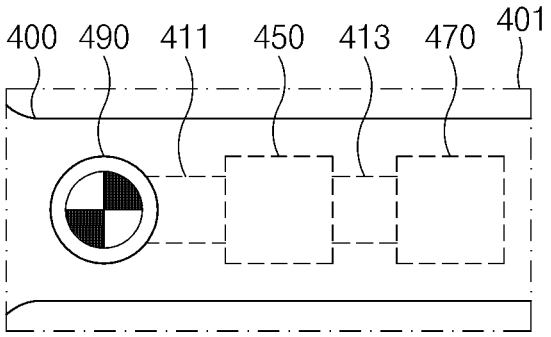
FIG. 4A is a plan view of a part of a strap, illustrating a form in which the smart key is embedded in the binding device according to an embodiment of the present disclosure.
Figure 4B:
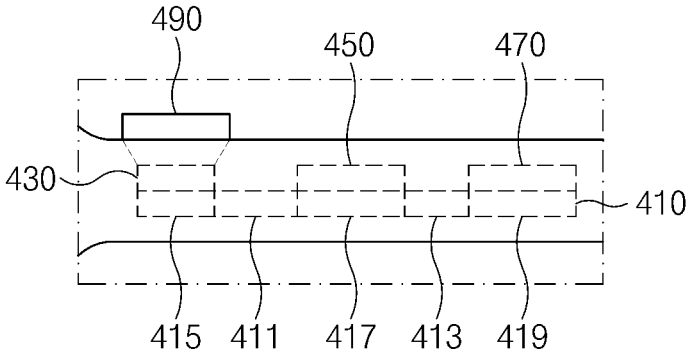
FIG. 4B is a side view of a part of the strap illustrated in FIG. 4A.

FIG. 4A is a plan view of a part of a strap, illustrating a form in which the smart key is embedded in the binding device according to an embodiment of the present disclosure. FIG. 4B is a side view of a part of the strap illustrated in FIG. 4A.

Referring to FIGS. 4A and 4B, the strap 400 of the binding device is configured such that a smart key is embedded in a specific band 401, i.e., the first band 130 or the second band 150 (FIG. 1). The specific band may be constructed from a bendable material. Furthermore, the specific band may have different bending degrees according to the materials or thicknesses thereof. According to an embodiment, the band may be constructed of different materials or thicknesses according to its distances from an opening (for example, the opening 110 of FIG. 1). For example, as the specific band becomes closer to the opening, the content of a rigid material may become larger or the thickness of the material may become thicker. Accordingly, the constituent elements of the smart key are disposed on the rigid printed circuit board at a location close to the opening, and the constituent elements of the smart key are disposed on the flexible printed circuit board at a location distant from the opening.

According to an embodiment of the present disclosure, the specific band is configured such that the circuit board 410 constitutes one of a flexible printed circuit board and a plurality of flexible printed circuit boards, disposed between the constituent elements included in the smart key to connect the constituent elements. As illustrated in FIG. 4A, a plurality of flexible printed circuit boards (for example, a first flexible printed circuit board 411 and a second flexible printed circuit board 413) are disposed between the constituent elements (for example, the battery 430, the control chip 450, and the first antenna 470) included in the smart key to connect the constituent elements. In this case, the constituent elements may be disposed in different rigid printed circuit boards. For example, the battery 430 may be disposed on the first rigid printed circuit board 415, the control chip 450 may be disposed on the second rigid printed circuit board 417, and the first antenna 470 may be disposed on the third rigid printed circuit board 419, respectively.

According to an embodiment of the present disclosure, at least one of the constituent elements included in the smart key may be separated from the strap 400. For example, the battery 430 may be separated from the strap 400 for replacement of the battery 430. In this case, the strap 400 may have a battery area (for example, the second area 141 of FIG. 1) having a predetermined size therein such that the battery 430 is seated on the specific band. The battery area is an empty space having a shape and a size that are the same as or similar to those of the battery 430 on at least one of the opposite surfaces of the specific band such that the battery 430 can be discharged to the outside for replacement. The strap 400 is coupled to a battery cover 490 (for example, the cover 145 of FIG. 1) that covers the battery area such that the battery 430 is not undesirably discharged (separated) to the outside.

As illustrated in FIG. 4B, the battery cover 490 is coupled to and protrudes outside of the strap 400. The battery cover 490 has a groove of a predetermined shape at an inner periphery thereof to be smoothly separated from the strap 400, and a separation preventing unit (for example, a rubber ring) may be disposed adjacent to the groove. Although the drawings show the battery cover 490 externally protruding from the strap 400, the battery cover 490 may be flush with or recessed inwards from a one surface of the strap 400. The battery cover 490 may include a spring or may be connected to a spring for push button type opening and closing.

Figure 5A:
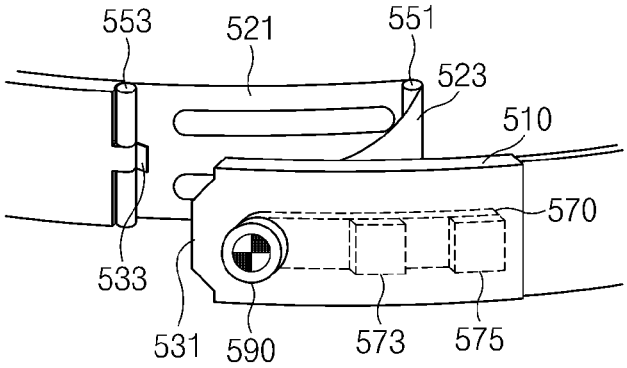
FIG. 5A is a perspective view of a part of the binding device illustrating a form in which the smart key is embedded in a binding part of the binding device according to an embodiment of the present disclosure.
Figure 5B:
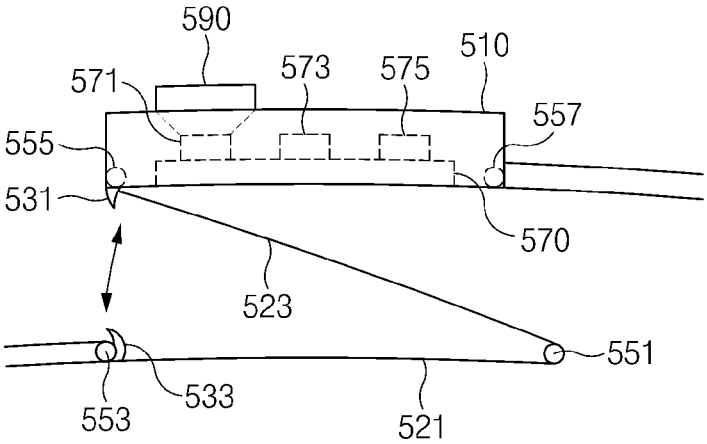
FIG. 5B is a side view of a part of the binding device illustrated in FIG. 5A.
Figure 5C:
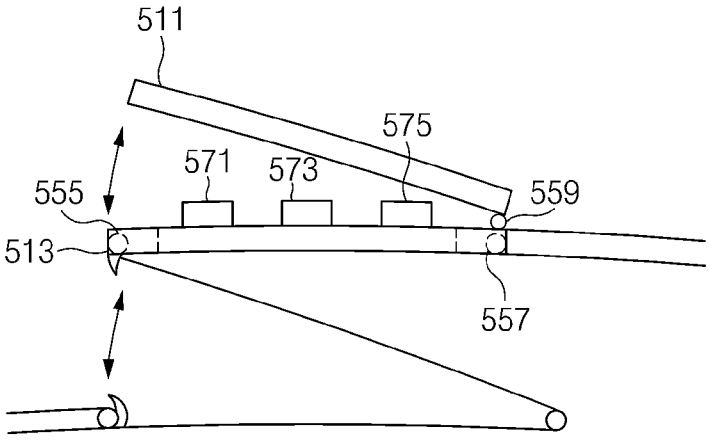
FIG. 5C is a side view illustrating opening of the binding part of the binding device of FIG. 5A.

FIG. 5A is a perspective view of a part of the binding device illustrating a form in which the smart key is embedded in a binding part of the binding device according to an embodiment of the present disclosure. FIG. 5B is a side view of a part of the binding device illustrated in FIG. 5A. FIG. 5C is a side view illustrating opening of the binding part of the binding device of FIG. 5A.

Referring to FIGS. 5A to 5C, the strap (for example, the strap 100 of FIG. 1) of the binding device has a binder (for example, at least one of the first binder 170 or the second binder 190 of FIG. 1) in a predetermined area of a periphery opposite to the surface, and an opening (for example, the opening 110 of FIG. 1) meets a specific band (at least one of the first band 130 or the second band 150 of FIG. 1). The binder may be a buckle of a predetermined size that fixes the band to a part of the body of the user.

As illustrated in FIG. 5A, the binder may be configured such that an upper cover 510 is folded with a lower support layer 521 and an extension layer 523. For example, the lower support layer 521 may be connected to the extension layer 523 through a first coupling 551, and may be folded with respect to the first coupling 551. Furthermore, the extension layer 523 may be connected to the upper cover 510 through a second coupling 555, and may be folded with respect to the second coupling 555. Through this, the upper cover 510, the extension layer 523, and the lower support layer 521 may be folded. A first hook 531 and a second hook 533 engage with each other when the upper cover 510, the extension layer 523, and the lower support layer 521 are folded, and maintain the engaging state until a force of a designated magnitude is applied in a designated direction. According to an embodiment of the present disclosure, the upper cover 510 and the lower support layer 521 may be connected to the specific band through a third coupling 553 and a fourth coupling 557.

According to an embodiment of the present disclosure, the smart key may be embedded in the binder. The smart key is embedded in the upper cover 510. For example, the battery 571, the control chip 573, the first antenna 575, and the like are embedded in the upper cover 510 on a circuit board 570. As another example, the upper cover 510 is coupled to the battery cover 590 that has a battery area (for example, the second area 141 of FIG. 1) such that the battery 571 is separated and covers the battery area. As illustrated in FIG. 5B, the battery cover 590 is coupled to and externally protrudes from the upper cover 510, and in another embodiment of the present disclosure, the battery cover 590, when coupled, is flat with an outer surface of the upper cover 510 or is inwardly recessed.

According to an embodiment of the present disclosure, as illustrated in FIG. 5C, the upper cover 510 is configured such that an upper layer 511 and a lower layer 513 are connected to each other through a fifth connector 559, forming an angle in a predetermined range with respect to the fifth connector 559 so that a predetermined area thereof may be separated or coupled thereto. In this case, at least one of the constituent elements (for example, the battery 571, the control chip 573, and the first antenna 575) of the smart key embedded in the upper cover 510 may be separated from the upper cover 510 for replacement.

According to an embodiment of the present disclosure, the binder may have various other forms, for example, at least one of the constituent elements of the binder may be omitted, or at least one constituent element may be added.

Figure 6A:
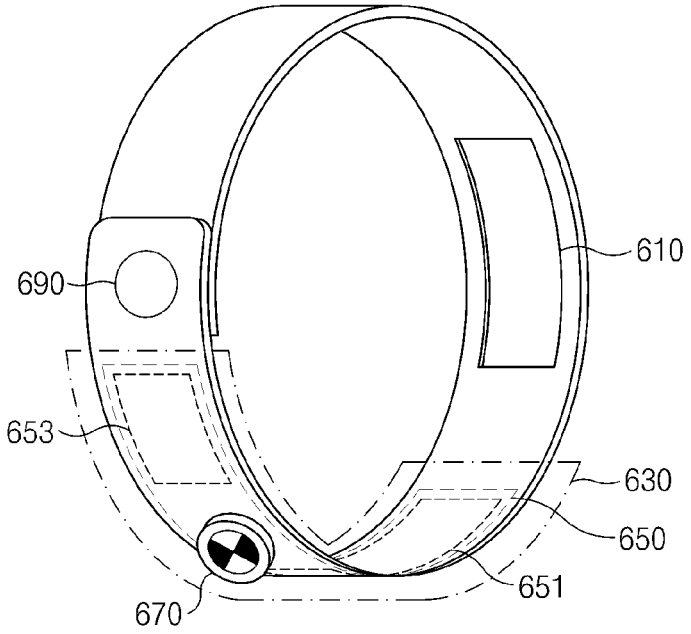
FIG. 6A is a perspective view of the binding device illustrating another manner in which the smart key is embedded in the binding device according to an embodiment of the present disclosure.
Figure 6B:
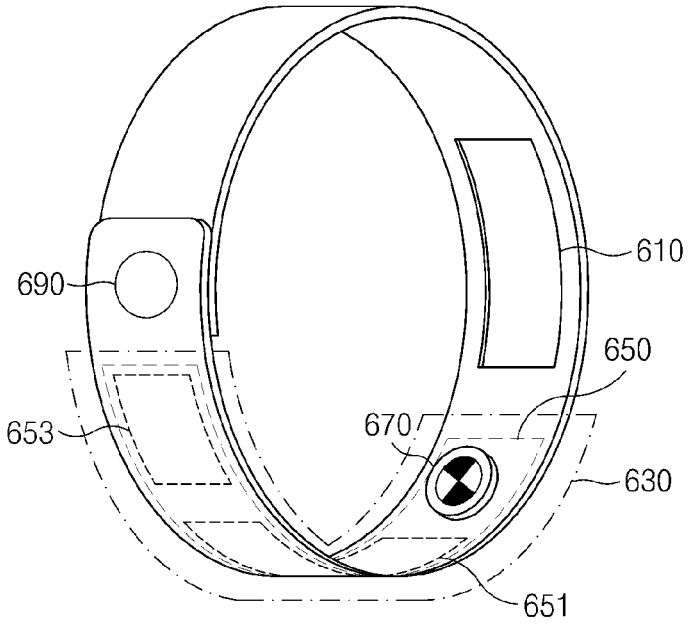
FIG. 6B is a perspective view of the binding device illustrating still another manner in which the smart key is embedded in the binding device according to an embodiment of the present disclosure.

FIG. 6A is a perspective view of the binding device illustrating another manner in which the smart key is embedded in the binding device according to an embodiment of the present disclosure. FIG. 6B is a perspective view of the binding device illustrating still another manner in which the smart key is embedded in the binding device according to an embodiment of the present disclosure.

Referring to FIGS. 6A and 6B, the strap (for example, the strap 100 of FIG. 1) of the binding device is configured such that the smart key circuit is constituted by one flexible printed circuit board therein. For example, the strap has an opening 610 in a predetermined area (for example, a central area), and has a specific band 630 connected to the opening 610 and extending from the opening 610 by a designated length in a designated direction. In this case, the control chip 651, the battery, the first antenna 653, and the like are disposed in the flexible printed circuit board 650 to be embedded in the specific band 630. The form in which the constituent elements of the smart key are disposed in the flexible printed circuit board 650 occupies a wide area relative to the form in which the constituent elements are disposed in the rigid printed circuit board and are connected to each other by a plurality of flexible printed circuit boards disposed between the constituent elements. Accordingly, the sequence, the locations, and the intervals of the constituent elements may be diversified.

As illustrated in FIG. 6A, in the specific band 630, the control chip 651, the battery, and the first antenna 653 are sequentially disposed on the flexible printed circuit board 630 by a predetermined interval with respect to the opening 610. FIG. 6B illustrates a form in which the battery, the control chip 651, and the first antenna 653 are sequentially disposed in the specific band 630 with respect to the opening 610. Even in this case, the first antenna 653 are disposed distant from the opening 610 relative to the other constituent elements, according to the interference sensitivity thereof.

According to an embodiment of the present disclosure, the battery may be separated from the specific band 630. In this case, the specific band 630 has a battery area (for example, the second area 141 of FIG. 1) such that the battery is seated on the battery area. Furthermore, the battery cover 670 that prevents separation of the battery is coupled to the specific band 630. The battery cover 670 is coupled to at least one of the opposite surfaces of the specific band 630. For example, as illustrated in FIG. 6A, the battery cover 670 is coupled to a surface opposite to a side on which the strap is bent and rolled inwards (for example, a surface opposite to one of the opposite surfaces of the specific band 630 that makes contact with a part of the body of the user). Alternatively, as illustrated in FIG. 6B, the battery cover 670 is coupled to a side on which the strap is bent and rolled inwards (for example, one of the opposite surfaces of the specific band 630 that makes contact with a part of the body of the user). The strap is fixed by the binder 690 while surrounding a part of the body of the user.

According to an embodiment of the present disclosure, the smart key is not limited to only being embedded in the binding device, and may be disposed in the body of an external electronic device, for example, a smart watch that is inserted into and connected to the opening 610. For example, at least a portion of the smart key circuit may be disposed in the body of the smart watch.

As described above, the form in which the smart key is embedded in the binding device enhances portability as compared with the form in which an independent device only for a smart key is provided. Further, it can reduce the size of an external electronic device as compared with the form in which the smart key is dependently disposed in the interior of the external electronic device, and accordingly, in-use efficiency can be enhanced.

Figure 7:
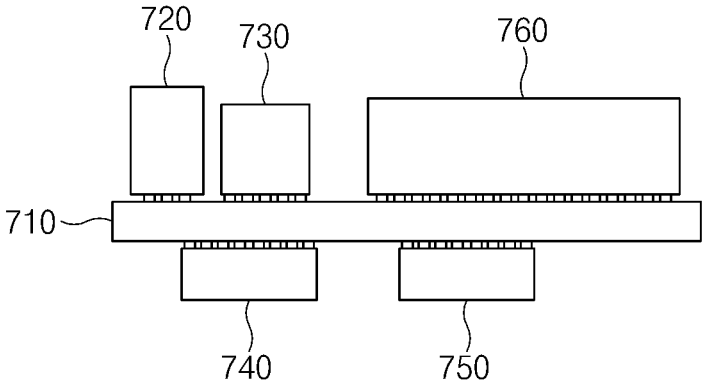
FIG. 7 illustrates a circuit of the smart key disposed in a restricted area according to an embodiment of the present disclosure.

FIG. 7 illustrates a circuit of the smart key disposed in a restricted area according to an embodiment of the present disclosure.

Referring to FIG. 7, the smart key circuit is disposed in a limited, i.e., restricted, area of a strap (for example, the strap 100 of FIG. 1). For example, the smart key circuit is embedded in the buckle of the strap. Accordingly, in the smart key circuit, the constituent elements (for example, a first part 720 of the first antenna, a second part 730 of the first antenna, a transmitter 740, a receiver 750, and a battery 760) are disposed on opposite surfaces of the circuit board 710. For example, the first part 720 of the first antenna, the second part 730 of the first antenna, and the battery 760 are disposed on an upper surface of the circuit board 710, and the transmitter 740 and the receiver 750 are disposed on a lower surface of the circuit board 710. In an embodiment of the present disclosure, the sequence, the locations, and the intervals of the constituent elements of the smart key may vary based on information about the interferences thereof and the sensitivities about the interferences of the constituent elements.

Figure 8:
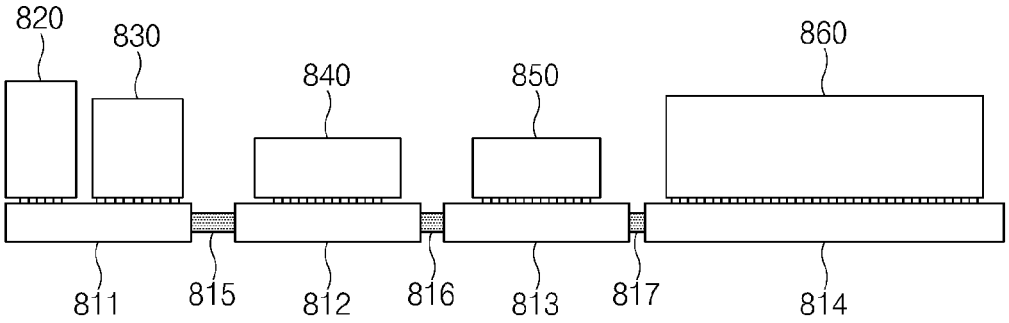
FIG. 8 illustrates circuits of the smart key disposed differently depending on the type of circuit boards according to an embodiment of the present disclosure.

FIG. 8 illustrates circuits of the smart key disposed differently depending on the type of circuit boards according to an embodiment of the present disclosure.

Referring to FIG. 8, the constituent elements of the smart key circuit are disposed differently based on the circuit board type. For example, in the smart key circuit, all of the constituent elements may be disposed in one flexible printed circuit board, or one or more of the constituent elements may be disposed in different rigid printed circuit boards and one or more flexible printed circuit boards may be disposed between the rigid printed circuit boards such that the constituent elements are connected to each other.

FIG. 8 illustrates the smart key circuit disposed on at least one rigid printed circuit board and at least one flexible printed circuit board. For example, the first antenna, i.e., a first part 820 of the first antenna and a second part 830 of the first antenna, is disposed on a first rigid printed circuit board 811, a transmitter 840 is disposed on a second rigid printed circuit board 812, a receiver 850 is disposed on a third rigid printed circuit board 813, and a battery 860 is disposed on a fourth rigid printed circuit board 814. Furthermore, a first connector 815 connects the first rigid printed circuit board 811 and the second rigid printed circuit board 812, a second connector 816 connects the second rigid printed circuit board 812 and the third rigid printed circuit board 813, and a third connector 817 connects the third rigid printed circuit board 813 and the fourth rigid printed circuit board 814. At least one or more than one of the first connector 815, the second connector 816, or the third connector 817 may be a flexible printed circuit board. According to an embodiment of the present disclosure, one or more of the constituent elements of the smart key circuit is disposed on a rigid printed circuit board, or is disposed on different surface of the same rigid printed circuit board.

As described above, according to an embodiment of the present disclosure, a binding device includes a strap including a body, a first area formed inside the body, with a smart key related control circuit disposed in the first area, and a second area formed on one side of the body, with a battery for supplying electric power for operating the smart key related control circuit is seated on the second area such that at least a portion of the battery is exposed, and a cover formed to cover the second area.

According to an embodiment of the present disclosure, the strap has at least one of a groove and a bump in a predetermined area of a side wall of the second area on which the battery is seated while making contact with the smart key related control circuit, and the cover has at least one of a bump and a groove in an area aligned with the predetermined area of the side wall to be coupled to the second area of the strap.

According to an embodiment of the present disclosure, at least one of the first area or the second area are formed in a binder of the strap.

According to an embodiment of the present disclosure, the binder includes an upper cover having an area having a predetermined size, and a lower support layer folded from the upper cover to support the upper cover, and the at least one of the first area or the second area formed inside the upper cover.

According to an embodiment of the present disclosure, the upper cover has an upper layer and a lower layer that form an angle in a designated range such that predetermined areas thereof are separated from or coupled to each other, and are formed such that at least a portion of the battery or at least a portion of the control circuit is exposed if the predetermined areas of the upper layer and the lower layer are separated from each other.

According to an embodiment of the present disclosure, the control circuit disposed in the first area is disposed on at least one of a rigid printed circuit board and a flexible printed circuit board, and includes at least one antenna that transmits and receives a signal in a specific frequency band.

According to an embodiment of the present disclosure, the control circuit disposed in the first area includes a first antenna that transmits and receives a signal in a first frequency band, and a sensing signal for sensing a target object is transmitted through the first antenna, an authentication signal including authentication information of the target object is received through the first antenna in response to the sensing signal, and a control signal for controlling the target object is transmitted through the first antenna.

According to an embodiment of the present disclosure, the control circuit includes a second antenna that transmits and receives a signal in a second frequency band different from the first frequency band of the first antenna, and the control signal is transmitted through the second antenna.

According to an embodiment of the present disclosure, the control circuit includes at least one of a communication circuit for communication with an external electronic device and a live body sensor for collecting biometric information.

Figure 9:
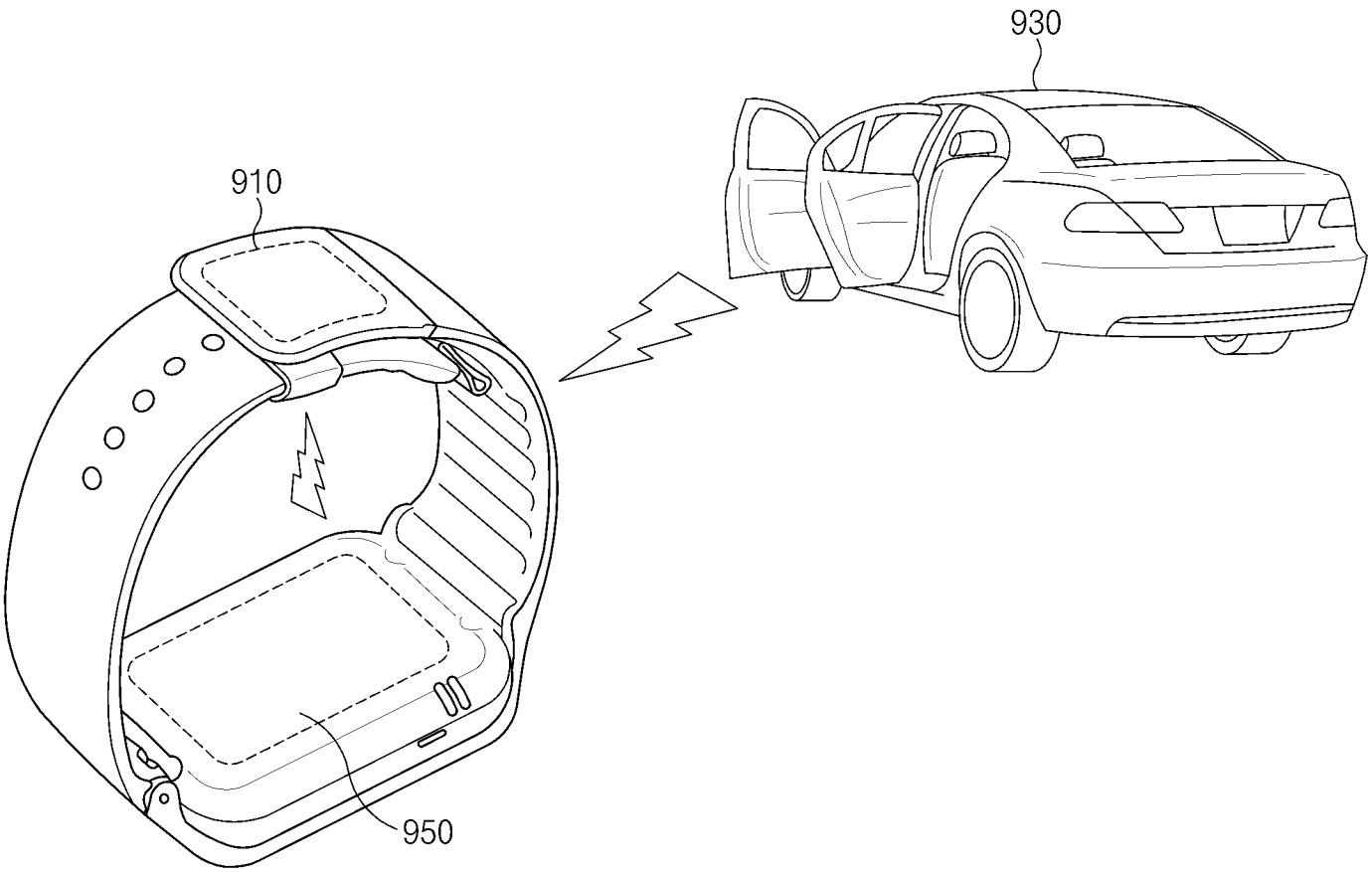
FIG. 9 illustrates interworking of the smart key with an external electronic device according to an embodiment of the present disclosure.

FIG. 9 illustrates interworking of the smart key with an external electronic device according to an embodiment of the present disclosure.

Referring to FIG. 9, a smart key 910 is embedded in the strap (for example, the strap 100 of FIG. 1) of the binding device, and the body of an external electronic device 950, for example, a smart watch is connected to the opening (for example, the opening 110 of FIG. 1) formed in the strap. The smart key 910 transmits a sensing signal in a specific frequency band at a designated time interval. For example, the smart key 910 transmits an LF signal containing sensing information using an LF antenna. Further, the smart key 910 receives an authentication signal in a specific frequency band from a target object 930. For example, the smart key 910 receives an LF signal containing authentication information using an LF antenna.

According to an embodiment of the present disclosure, the smart key 910 authenticates the target object 930 by analyzing the authentication signal. For example, the smart key 910 extracts authentication information contained in the authentication signal, and identifies whether the extracted authentication information is the same as authentication information about the target object 930 stored in the smart key 910. Based on a result of the identification of the extracted authentication information, the smart key 910 determines whether the target object 930 is an authenticated object. In this regard, the smart key 910 includes a memory for additionally storing the authentication information. Furthermore, the smart key 910 receives the authentication information from the external electronic device 950.

According to an embodiment of the present disclosure, the smart key 910 transmits a control signal for controlling the authenticated object 930. For example, the smart key 910 transmits an RF signal containing control information to the target object 930 using an RF antenna. According to an embodiment, the smart key 910 transmits a control signal regarding opening and closing of a lock of a target object, or initiation and completion of a specific function of the target object to the target object 930. Furthermore, the smart key 910 receives a feedback signal about the control signal from the target object 930. The feedback signal contains transmission result information about the control signal, and in an embodiment of the present disclosure, contains performance result information about the control signal. For example, when the control signal contains information for turning on a starter of a vehicle, the feedback signal contains transmission completion information about the control signal, startup state information of a vehicle, or information about the temperature of an engine, the power level of a battery, or a fuel level when the starter of the vehicle is turned on. In an embodiment of the present disclosure, the smart key 910 transmits the feedback signal to the external electronic device 950.

According to an embodiment of the present disclosure, the smart key 910 also includes various sensors, e.g. a live body sensor, a gesture sensor, a voice sensor, a GPS sensor, or a touch sensor. According to an embodiment, the smart key 910 authenticates a user having authority to control the target object 930 based on the sensors. According to an embodiment, the smart key 910 collects biometric information of the user, for example, one of fingerprint information and iris information from the user, based on the live body sensor. Furthermore, the smart key 910 authenticates the user using biometric information collected based on the live body sensor. In relation to the authentication of the user, the smart key 910 collects biometric information (for example, fingerprint information) of users for user authentication from a memory included in the smart key 910. In this regard, the smart key 910 receives biometric information registered by the users to be used in authentication and stores the received biometric information in the memory. Furthermore, the smart key 910 collects biometric information of the users used in user authentication from the external electronic device 950. The smart key 910 transmits the biometric information, user authentication information authenticated using the biometric information and the like to the external electronic device 950. Through this, the smart key 910 or the external electronic device 950 that authenticated the user obtains an authority for controlling the target object 930. In addition, the smart key 910 collects information about blood pressure, blood flow rate, body temperature, user heart rate, and the like based on the live body sensors and transmits the information to the external electronic device 950.

According to an embodiment of the present disclosure, the smart key 910 performs a control function of the target object 930 based on the sensors. According to an embodiment, the smart key 910 receives a user input based on the sensors, and performs a control function corresponding to the user input. For example, the smart key 910 analyzes gesture input information, voice information, location information, touch information, or the like collected based on the sensors, and performs a control function corresponding to the information. If the user inputs voice information (for example, "Start the engine") designated by initiation of a specific function (for example, turning on of a starter of a vehicle) of the target object 930 to a voice sensor included in the smart key 910, the smart key 910 analyzes the voice information and performs the corresponding control function. Further, when the user approaches the target object 930 while carrying (or wearing) the smart key 910, the smart key 910 detects an approach of the smart key 910 to the target object 930 based on a GPS sensor included in the smart key 910 and performs a control function designated to be performed when the smart key 910 approaches the target object 930, for example, a lock releasing function. In addition, the smart key 910 controls the target object 930 based on the sensors in various methods. For example, the smart key 910 detects a touch, a gesture, or a voice of the user based on the sensors, or when recognizing location information of the user, performs a designated control function regarding, for example, opening of a door of a vehicle, turning on the vehicle light, opening of a trunk, or automatic startup of the vehicle according to the corresponding information.

The target object 930 receives a sensing signal from the smart key 910, and transmits an authentication signal containing authentication information of the target object 930 to the smart key 910. The target object 930 includes constituent elements for a main function and peripheral functions of the target object 930. For example, when the target object 930 is a vehicle, the vehicle includes a steering apparatus for a movement function of the vehicle, an accelerator, and various mechanical apparatuses.

The external electronic device 950 is provided as a body connected to the strap, and may be operated independently from the smart key 910 or may be operated in conjunction with the smart key 910. According to an embodiment, the external electronic device 950 receives user authentication information from the smart key 910. In this case, the external electronic device 950 authenticates the user based on the authentication information, and displays a control function list by which the target object 930 is controlled on a display when the user is authenticated. Furthermore, in response to selection of a specific control function item contained in the displayed control function list, the external electronic device 950 delivers the corresponding information to the smart key 910, or directly delivers a control signal corresponding to a control function to the target object 930. In this regard, the control function list includes at least one function item which the target object 930 performs. For example, when the target object 930 is a vehicle, the control function list includes a temperature control unit controlling function, a traffic situation information collecting function, or a vehicle state information providing function.

According to an embodiment, the external electronic device 950 performs a control function of the target object 930 based on various sensors included in the external electronic device 950. According to an embodiment, the external electronic device 950 includes a gesture sensor or a touch sensor. In this case, if a specific user input (for example, a gesture input or a touch input) is received through the sensors, the external electronic device 950 performs a control function corresponding to the user input. Furthermore, the external electronic device 950 delivers at least one of the user input or information related to a control function corresponding to the user input to the smart key 910.

According to an embodiment, in relation to a function of controlling the target object 930 based on the sensors, the external electronic device 950 may differently perform a control function of the target object 930 according to the received user input. According to an embodiment, the external electronic device 950 controls the target object 930 in stages according to the types, numbers, or times of the user inputs. For example, the external electronic device 950 performs control functions in stages in the input time sequence if a specific gesture input is repeatedly input for a designated time period at a predetermined time interval. According to an embodiment, a function of releasing a lock of the target object 930 is performed in a first step, and initiating a specific function (for example, turning on a starter or turning on a light) of the target object 930 is sequentially performed in second to fourth steps. For example, when the target object 930 is a vehicle, a driver side door is opened in the first step, the engine starter is turned on in the second step, front lights of the vehicle are turned on in the third step, and all interior lights of the vehicle are turned on in the fourth step. Furthermore, all of the vehicle doors are opened if a specific gesture input or a specific touch input is generated a designated number of times (for example, twice) within a predetermined time. The external electronic device 950 performs a control function in stages at a designated time interval from the predetermined time if a specific touch input is continuously input for a designated time period.

According to an embodiment, the external electronic device 950 receives a feedback signal from the smart key 910. In this case, the external electronic device 950 displays information contained in the feedback signal on a display contained in the external electronic device 950, which displays transmission result information about the control signal or performance result information about the control signal.

According to an embodiment, the external electronic device 950 analyzes information contained in the feedback signal, and performs a specific function according to the corresponding information. According to an embodiment, the external electronic device 950 performs a vibration alarm function if performance result information about initiation of a specific function of the target object 930 (for example, turning on of the vehicle) is received. Furthermore, the external electronic device 950 delivers information (for example, the engine temperature, the amount of fuel, or speed of the vehicle) together with initiation of a specific function to another external electronic device (for example, a smartphone of another passenger on the vehicle) connected to the target object 930.

According to an embodiment, the smart key 910 may control another smart key having a control authority of the target object 930. For example, the smart key 910 may control another smart key having authentication information of the users having a control authority about the target object 930. According to an embodiment, the smart key 910 may perform a control function of the target object 930 through the other smart key.

Figure 10:
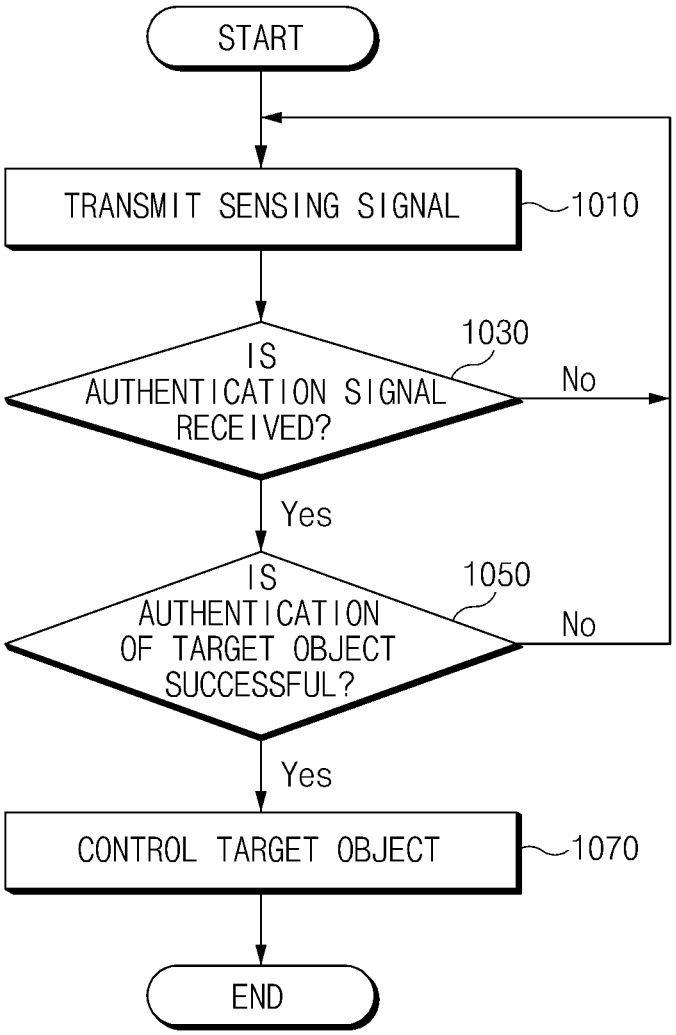
FIG. 10 is a flowchart of an operating method of the smart key according to an embodiment of the present disclosure.

FIG. 10 is a flowchart of an operating method of the smart key according to an embodiment of the present disclosure.

Referring to FIG. 10, a smart key (for example, the smart key 300 of FIG. 3) transmits a sensing signal in operation 1010. For example, the smart key transmits a sensing signal in a specific frequency band using a first antenna (for example, the first antenna 350 of FIG. 3).

In operation 1030, the smart key determines whether an authentication signal is received from a target object. For example, the smart key receives an authentication signal in a specific frequency band through the first antenna. When receiving the authentication signal, in operation 1050, the smart key determines whether the target object is successfully authenticated based on the authentication signal. For example, the smart key extracts authentication information of the target object contained in the authentication signal, and compares the extracted authentication information with authentication information stored in the smart key or received from the external electronic device. When the two pieces of information are the same or are similar by at least a predetermined ratio, the smart key is determined to have successfully authenticated the target object. When an authentication signal is not received in operation 1030 or an authentication of the target object fails in operation 1050, operation 1010 is repeated.

When the authentication of the target object is successful, in operation 1070, the smart key controls the target object. For example, the smart key transmits to the target object a control signal to perform a function contained in the target object.

Figure 11:
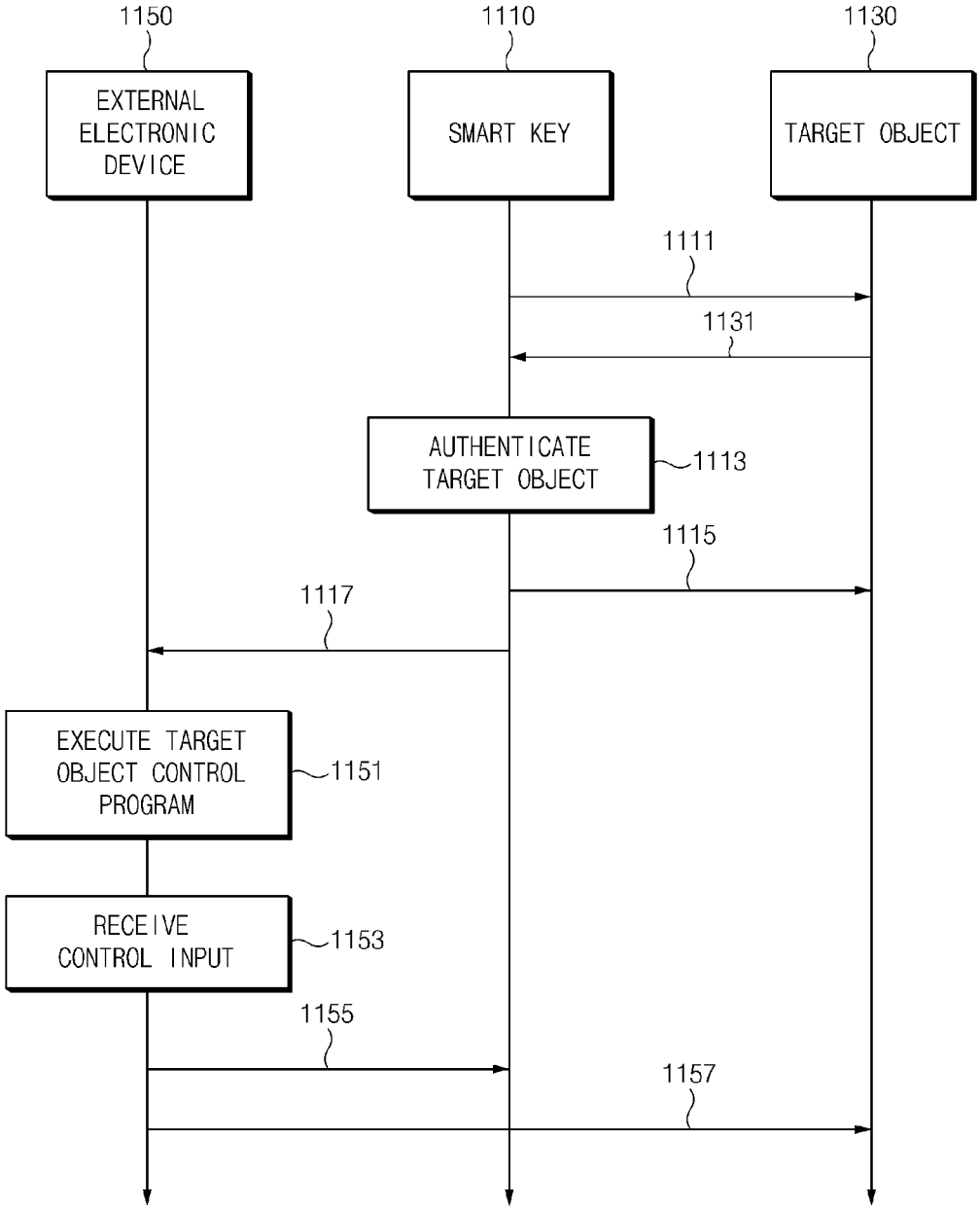
FIG. 11 is a flow diagram illustrating interworking of the smart key with an external electronic device according to an embodiment of the present disclosure.

FIG. 11 is a flow diagram illustrating interworking of the smart key with an external electronic device, according to an embodiment of the present disclosure.

Referring to FIG. 11, in operation 1111, the smart key 1110 transmits a sensing signal for sensing a target object 1130. If the target object 1130 receives the sensing signal, in operation 1131, the target object 1130 transmits to the smart key 1110 an authentication signal containing authentication information of the target object 1130.

If the smart key 1110 receives the authentication signal, in operation 1113, the smart key authenticates the target object 1130. For example, it may be determined whether the user or owner of the smart key 1110 is the same as the user or owner of the target object 1130. If the user or owner of the smart key 1110 is the same as the user or owner of the target object 1130, a determination is made of whether a control function of the target object 1130 is used. When an authentication of the target object 1130 fails, the process may return to operation 1111. When the authentication of the target object 1130 is successful, in operation 1115, the smart key 1110 transmits a control signal about the target object 1130 to the target object 1130.

In operation 1117, the smart key 1110 sends at least one of the authentication signal or the authentication information to the external electronic device 1150. The external electronic device 1150 authenticates the target object 1130 based on the authentication information or authentication information contained in the authentication signal. In operation 1151, the external electronic device 1150 executes a target object control program. The target object control program may be a program that causes various functions contained in the target object 1130 to be performed according to the type of the target object 1130. The external electronic device 1150 displays a control function list including various functions contained in the target object 1130 as items. The external electronic device 1150 outputs voice information corresponding to the control function list through a voice output unit.

In operation 1153, the external electronic device 1150 receives a control input from the user. For example, the external electronic device 1150 selects a specific control function item contained in the control function list and receives the selected specific control function item from the user. In operation 1155, the external electronic device 1150 sends corresponding information to the smart key 1110 in response to selection of the specific control function item. In this case, the smart key 1110 adds the corresponding information to the control signal and transmits the control signal to the target object 1130. In operation 1157, the external electronic device 1150 directly sends a control signal corresponding to the specific control function item to the target object 1130.

As described above, a method is provided for controlling a target object of a binding device including transmitting a sensing signal for sensing the target object through a first antenna that transmits and receives a signal in a first frequency band, with the first antenna provided in a smart key related control circuit disposed inside a strap of the binding device, receiving an authentication signal including authentication information of the target object through the first antenna in response to the sensing signal, authenticating the target object based on the authentication information contained in the authentication signal, and transmitting a control signal for controlling the target object through the first antenna.

According to an embodiment, the transmitting of the control signal includes transmitting the control signal through a second antenna that transmits and receives a signal in a second frequency band different from the first frequency band of the first antenna.

According to an embodiment, the authenticating of the target object includes comparing the authentication information with at least one of authentication information of the target object stored in a memory of the binding device and authentication information of the target object collected from an external electronic device.

According to an embodiment, the method further includes transmitting authentication information of the target object to the external electronic device through a communication circuit provided in the control circuit for communication with an external electronic device.

According to an embodiment, the method further includes collecting biometric information of the user based on a live body sensor provided in the control circuit, authenticating the user using the biometric information, and transmitting at least one of the biometric information or authentication information of the user authenticated using the biometric information to an external electronic device through a communication circuit provided in the control circuit for communication with the external electronic device.

According to an embodiment, the method further includes receiving a feedback signal about the control signal, and transmitting the feedback signal to the external electronic device through a communication circuit provided in the control circuit for communication with the external electronic device.

According to an embodiment, the method further includes receiving a signal containing information about a specific control function from an external electronic device through a communication circuit for communication with the external electronic device, and generating a control signal based on the information about the specific control function contained in the signal and transmitting the control signal to the target object.

The term "module" used herein means a unit including, for example, one of hardware, software, or firmware or a combination of the two or more of them. The module may be interchangeably used, for example, with a unit, a logic, a logical block, a component, or a circuit. The module may be a minimum unit or a part of an integrally configured part. The module may be a minimum unit or a part which performs one or more functions. The module may be implemented mechanically or electromagnetically. For example, the module may include at least one of an application-specific integrated circuit (ASIC) chip, a field-programmable gate array, or a programmable-logic device, which has been known, will be developed in the future, or performs certain operations.

At least some of the devices (for example, modules or functions) or methods (for example, operations) may be implemented by an instruction stored in a computer-readable storage medium, for example, in the form of a program module. When the instruction is executed by the processor, the at least one processor may perform a function corresponding to the instruction. The computer-readable storage medium may be, for example, a memory.

The computer-readably storage medium may include a hard disk, a floppy disk, a magnetic medium (for example, a magnetic tape), an optical medium (for example, a compact disk read only memory (CD-ROM)), a digital versatile disk (DVD), a magneto optical medium (for example, a floptical disk), a hardware device (for example, a read only memory (ROM), a random access memory (RAM), or a flash memory). Further, the program instructions may include high-level language codes which may be executed by a computer using an interpreter as well as machine languages created using a compiler. The above-mentioned hardware device may be configured to be operated as one or more software module to perform operations of an embodiment of the present disclosure, and the converse is true.

The module or program module according to an embodiment of the present disclosure may include at least one of the above-mentioned elements, omit some of them, or further include other elements. The module, the program module, or the operations performed by other elements according to an embodiment of the present disclosure may be performed in a sequential, parallel, iterative, or heuristic method. Further, some operations may be executed in another sequence or may be omitted, or other operations may be added. Further, the embodiments disclosed in the specification are provided to describe the technical contents or for understanding of the technical contents, and the technical scope of the present disclosure is not limited thereto. Accordingly, the scope of the present disclosure should be construed to include all changes or an embodiment of the present disclosure based on the technical spirit of the present disclosure.

According to an embodiment of the present disclosure, the portability and in-use efficiency of a smart key can be enhanced by providing a binding device having a smart key therein.

Furthermore, according to an embodiment of the present disclosure, a user interface function of a smart key using an external electronic device can be implemented by providing a binding device including a communication circuit for communication with the external electronic device connected to the binding device.

While the present disclosure has been shown and described with reference to certain embodiments thereof, it will be understood by those skilled in the art that various changes in form and details may be made therein without departing from the spirit and scope of the present disclosure as defined by the appended claims and their equivalents.

What is claimed is:

1. A binding device comprising:

a strap comprising a body connected to a pair of bands, one of the bands including a first area with a smart key related control circuit and a second area, wherein a battery for supplying electric power for operating the smart key related control circuit is seated on the second area such that at least a portion of the battery is exposed; and a cover configured to cover the second area.

2. The binding device of claim 1, wherein the strap has at least one of a groove and a bump in a predetermined area of a side wall of the second area on which the battery is seated while making contact with the smart key related control circuit, and the cover has at least one of a bump and a groove in an area aligned with the predetermined area of the side wall to be coupled to the second area of the strap.

3. The binding device of claim 1, wherein at least one of the first area and the second area is formed in a binder of the strap.

4. The binding device of claim 3, wherein the binder comprises an upper cover having an area having a predetermined size, and a lower support layer folded from the upper cover to support the upper cover, and wherein the at least one of the first area and the second area is formed inside the upper cover.

5. The binding device of claim 4, wherein the upper cover has an upper layer and a lower layer that form an angle in a designated range such that predetermined areas thereof are separated from or coupled to each other, and the upper cover is formed such that at least a portion of the battery or at least a portion of the smart key related control circuit is exposed if the predetermined areas of the upper layer and the lower layer are separated from each other.

6. The binding device of claim 1, wherein the smart key related control circuit is disposed on at least one of a rigid printed circuit board and a flexible printed circuit board, and the smart key related control circuit comprises at least one antenna that transmits and receives a signal in a specific frequency band.

7. The binding device of claim 1, wherein the smart key related control circuit disposed in the first area comprises a first antenna that transmits and receives a signal in a first frequency band, and wherein a sensing signal for sensing a target object is transmitted through the first antenna, an authentication signal comprising authentication information of the target object is received through the first antenna in response to the sensing signal, and a control signal for controlling the target object is transmitted through the first antenna.

8. The binding device of claim 7, wherein the smart key related control circuit further comprises a second antenna that transmits and receives a signal in a second frequency band different from the first frequency band, and wherein the control signal is transmitted through the second antenna.

9. The binding device of claim 1, wherein the smart key related control circuit further comprises at least one of a communication circuit for communication with an external electronic device and a live body sensor for collecting biometric information.

10. A method for controlling a target object of a binding device including a strap including a body connected to a pair of bands, the method comprising:

transmitting a sensing signal for sensing the target object through a first antenna that transmits and receives a signal in a first frequency band, wherein the first antenna is provided in a smart key related control circuit disposed inside one of the bands and a battery for supplying electric power for operating the smart key related control circuit is seated on the one of the bands;

receiving an authentication signal comprising authentication information of the target object through the first antenna in response to the sensing signal;

authenticating the target object based on the authentication information contained in the authentication signal; and transmitting a control signal for controlling the target object through the first antenna.

11. The method of claim 10, wherein transmitting the control signal comprises:

transmitting the control signal through a second antenna that transmits and receives a signal in a second frequency band different from the first frequency band of the first antenna.

12. The method of claim 10, wherein authenticating the target object comprises:

comparing the authentication information with at least one of authentication information of the target object stored in a memory of the binding device and authentication information of the target object collected from an external electronic device.

13. The method of claim 10, further comprising:

transmitting the authentication information of the target object to an external electronic device through a communication circuit provided in the smart key related control circuit for communication with the external electronic device.

14. The method of claim 10, further comprising:

collecting biometric information of a user based on a biometric sensor provided in the smart key related control circuit;

authenticating the user using the biometric information; and transmitting at least one of the biometric information and authentication information of the user authenticated using the biometric information to an external electronic device through a communication circuit provided in the smart key related control circuit for communication with the external electronic device.

15. The method of claim 10, further comprising:

receiving a feedback signal about the control signal; and transmitting the feedback signal to an external electronic device through a communication circuit provided in the smart key related control circuit for communication with the external electronic device.

16. The method of claim 10, further comprising:

receiving a signal containing information about a specific control function from an external electronic device through a communication circuit for communication with the external electronic device;

generating a control signal based on the information about the specific control function contained in the signal; and transmitting the control signal to the target object.

* * * * *